US007992680B2

(12) United States Patent
Small

(10) Patent No.: US 7,992,680 B2
(45) Date of Patent: Aug. 9, 2011

(54) RIGID RAIL FALL PROTECTION APPARATUS HAVING BYPASSABLE MOVEABLE ANCHORAGES

(76) Inventor: Greg Small, Calgary (CA)

( * ) Notice: Subject to any disclaimer, the term of this patent is extended or adjusted under 35 U.S.C. 154(b) by 743 days.

(21) Appl. No.: 11/460,673

(22) Filed: Jul. 28, 2006

(65) Prior Publication Data

US 2008/0023267 A1 Jan. 31, 2008

(51) Int. Cl.
*A62B 35/00* (2006.01)

(52) U.S. Cl. ..... 182/36

(58) Field of Classification Search ..... 182/36; 104/89, 91, 93–95, 106, 111
See application file for complete search history.

(56) References Cited

U.S. PATENT DOCUMENTS

| | | | | |
|---|---|---|---|---|
| 299,394 | A * | 5/1884 | Jenkins | 104/93 |
| 2,920,581 | A * | 1/1960 | Cook et al. | 104/93 |
| 3,159,978 | A * | 12/1964 | De Lillo | 405/282 |
| 3,729,827 | A | 5/1973 | Perminov | |
| 4,572,329 | A * | 2/1986 | Kleveborn | 182/9 |
| 5,526,896 | A | 6/1996 | O'Rourke | |
| 5,592,883 | A * | 1/1997 | Andress, III | 104/88.03 |
| 5,606,430 | A | 2/1997 | Roby et al. | |
| 5,799,760 | A | 9/1998 | Small | |
| 6,269,904 | B1 | 8/2001 | Morhaus | |
| 6,334,507 | B1 | 1/2002 | Westerweel | |
| 6,354,299 | B1 | 3/2002 | Austin | |
| 6,478,112 | B2 | 11/2002 | Lee | |
| 6,488,118 | B1 | 12/2002 | Corriveau | |
| 6,571,912 | B2 * | 6/2003 | Soll | 182/36 |
| 2002/0179368 | A1 * | 12/2002 | Evangelista | 182/3 |

FOREIGN PATENT DOCUMENTS

| | | |
|---|---|---|
| EP | 0090160 A2 | 10/1983 |
| EP | 0090160 A3 | 5/1984 |
| GB | 2241478 | 9/1991 |
| GB | 2256408 | 12/1992 |

OTHER PUBLICATIONS www.tritechfallprotection.com/resources/terms.cfm ; Fall protection terms/definitions; accessed Nov. 8, 2005.
www.cdc.gov/elcosh/docs/d0200/d000288/d000288.html ; eLCOSH Horizontal Fall Arrest System; Accessed Feb. 15, 2006.
www.labsafety.com/refinfo/ezfacts/ezfl30.htm ; ezFACTS Fall Protection Equipment ; Accessed Jan. 17, 2006.
www.msanet.com ; MSA (FP) Ref #: SRL-001 ; MSA Sure-Rail (TM) System; Jan. 7, 2002 8 pages.

* cited by examiner

*Primary Examiner* — Alvin C Chin-Shue
(74) *Attorney, Agent, or Firm* — Sean W Goodwin

(57) ABSTRACT

A fall protection apparatus includes a single longitudinally extending rigid rail onto which two laterally spaced apart moveable lanyard anchorages are mounted. The rail has a generally H-shaped cross-section with opposing vertically oriented first and second tracks laterally spaced apart by a connecting member extending between the tracks and substantially continuously along the length of the tracks The apparatus is attached to a structure by a support member, such as an overhead or lower support member, with the support member being attached to an upper or lower surface of the connecting member respectively. Each anchorage is adapted to be independently moveable along the length of one of the tracks, with the tracks being sufficiently spaced apart to permit the anchorages to freely pass by each other and the attachment point.

18 Claims, 7 Drawing Sheets

RIGID RAIL FALL PROTECTION APPARATUS HAVING BYPASSABLE MOVEABLE ANCHORAGES

FIELD OF THE INVENTION

The invention relates to fall protection apparatus and in particular to a fall protection apparatus of the type having a rigid rail with moveable anchorages to permit a worker to move along a length of a work area.

BACKGROUND OF THE INVENTION

Many work situations require workers to be positioned on top of platforms or vehicles that cannot be practically protected by a guardrail system enclosing the work area. To prevent the workers from falling from such elevated positions and thereby sustaining serious or mortal injuries, various fall protection systems can be used. In general, fall arrest or fall protection systems are designed to prevent the worker from reaching an unprotected edge or to quickly stop a fall before the worker impacts a lower level. Such systems typically include an anchorage secured to a structure overhead the work area, a safety harness worn by the worker, and a flexible tether line or "lanyard" interconnecting the anchorage to the harness.

One type of fall protection system includes a trolley or other moveable anchorage that is moveably mounted on a track provided by a rigid rail installed parallel to and above, the length of the working area. A moveable anchorage is particularly useful when the work area is narrow and long, for example, on top of a line of vehicles such as buses or rail cars. In general, the moveable anchorage is designed to freely move along the rail by engaging the rail track to permit movement in a longitudinal direction but at the same time preventing the anchorage from separating from the rail or moving in a transverse direction. Consequently, the worker can freely move along the length of the work area with the lanyard being kept at a minimum length at all times so as to reduce the risk of an undesirable pendular swinging motion in the event of a fall.

Rigid rail systems can use various structural members to provide the track, such as, for example, flanged beams, slotted hollow tubes, and flat bars, with the moveable anchorage typically being a wheeled trolley. The rigid rail must be structurally supported on an overhead structure to hold the rail in place and to support the weight of the moveable anchorage and any connected workers in the event of a fall.

Most conventional rigid rail systems use a flanged beam installed in the "I" orientation, having horizontally oriented flanges and a vertically oriented web. The movable anchorage is typically a wheeled trolley having a U-shaped profile whose wheels are supported on the bottom flange straddling the web. Overhead support members are attachment to the top of the flanged-beam for attachment to an overhead structure. Orientation of the flanged beam in the "I" orientation provides the most structurally efficient rail because the greatest amount of material is concentrated at the top and the bottom of the beam to provide greatest strength and stiffness of the beam.

In another type of rigid rail system, a horizontally extending flat bar is installed with the plane of the bar being vertically oriented. The moveable anchorage is typically a wheeled trolley having a C-shaped profile and at least one set of upper and lower flanged wheels rolling on a top edge and bottom edge of the bar, respectively. The bar is supported by periodic and longitudinally spaced horizontal support members attached to a side of the bar, with the periodic support members being located at mid height of the bar so as to not interfere with free movement of the trolley past the supports. A disadvantage of the use of a bar as compared to an I-oriented flanged beam is that the bar has less torsional and transverse bending stiffness, resulting is a significant tendency to buckle in a lateral-torsional mode when subjected to a vertical load. Consequently, the bar does not participate in carrying long-span loadings. Further, to help restrain the bar from lateral-torsional buckling, the bar must be attached to closely spaced, torsionally rigid periodic supports. For example, a bar typically requires periodic support members every 3 to 6 feet, while the same length of I-oriented flanged beam typically requires a support member every 10 to 25 feet. Where overhead attachments are widely spaced, it is necessary to attach the bar to an independent and intermediate structural member, such flanged beam or a tube section, which is capable of carrying vertical loads over the span and the periodic support members are spaced therealong. In either case, the requirement for additional components for using a bar-type rail greatly increases the cost of the completed system.

In some situations, it is desirable to permit two or more workers to independently and freely traverse the entire length of a work area. The solution has been to install separate, parallel rails, with each rail having a moveable anchorage to which one of the workers is connected. Such rails can be supported by independent support members, or the separate rails can be attached to a common supporting member. For example, the MSA "twin track" Sure-Rail™ System (Pittsburgh, Pa.) comprises an assembly of two bar rail systems attached to a central and intermediate support member by periodic support plates, and the intermediate support member is supported from overhead attachments. More particularly, the horizontal periodic support members of each bar are attached to separate vertical support plates, with the support plates in turn being attached to opposing sides of the intermediate central support member. In any case, the need to install separate parallel rails represents significant manufacturing and labor costs.

There is, therefore, a need in the art for an improved rigid rail fall protection apparatus.

SUMMARY OF THE INVENTION

The fall protection apparatus of the present invention provides a single substantially horizontally and longitudinally extending rigid rail onto which two laterally spaced apart moveable anchorages are mounted. Each moveable anchorage is adapted to be independently movable along the length of the rail, with the anchorages being permitted to freely bypass one another therealong. Advantageously, two workers attached to separate anchorages can use the fall protection apparatus and pass by each other in an unimpeded manner. Further, as the fall protection apparatus requires only a single rigid rail and associated support system to accomplish this, the rail is simpler and less costly to construct and install than prior art dual rail systems.

In one embodiment, the rigid rail is a flanged beam oriented in the "H" direction to have a horizontally oriented web and opposing vertically oriented flanges, with the moveable anchorages being wheeled trolleys. Each trolley includes at least one set of upper and lower wheels that are positioned to engage an upper and lower edge of one of the flanges for rolling movement therealong. Overhead support members are attached to an upper surface of the web for suspending the apparatus from a structure.

Accordingly, in a broad aspect of the invention, a fall protection apparatus is provided comprising: a longitudinally and substantially horizontally extending rigid rail having a generally H-shaped cross-section comprising opposing substantially vertically oriented first and second tracks laterally spaced apart by a substantially horizontally oriented connecting member extending between the tracks and substantially continuously along the length of the tracks. The first and second tracks support forces from arresting falls imposed by a first and a second moveable anchorage which are adapted to be mounted on the first and second tracks, respectively, for movement along the length of the tracks. An upper or lower surface of the connecting member provides an attachment point to attach the rail to at least one support member, such as a substantially vertical support member. The tracks are sufficiently spaced apart to permit the first and second anchorages to pass by each other and the attachment point while moving along their respective tracks.

As the connecting member extends substantially continuously along the length of the track, the propensity for torsional buckling of the rail when in use is greatly reduced or eliminated, particularly if the connecting member is of sufficient stiffness. The rail also preferably includes stops at either end for arresting movement of the anchorages to prevent the moveable anchorages from falling off the ends.

The invention also provides a fall protection system comprising the fall protection apparatus and attached vertical support members.

Other aspects of the fall protection apparatus are also disclosed.

BRIEF DESCRIPTION OF THE DRAWINGS

In drawings which are intended to illustrate embodiments of the invention and which are not intended to limit the scope of the invention.

DESCRIPTION OF THE PREFERRED EMBODIMENT

Figure 1:
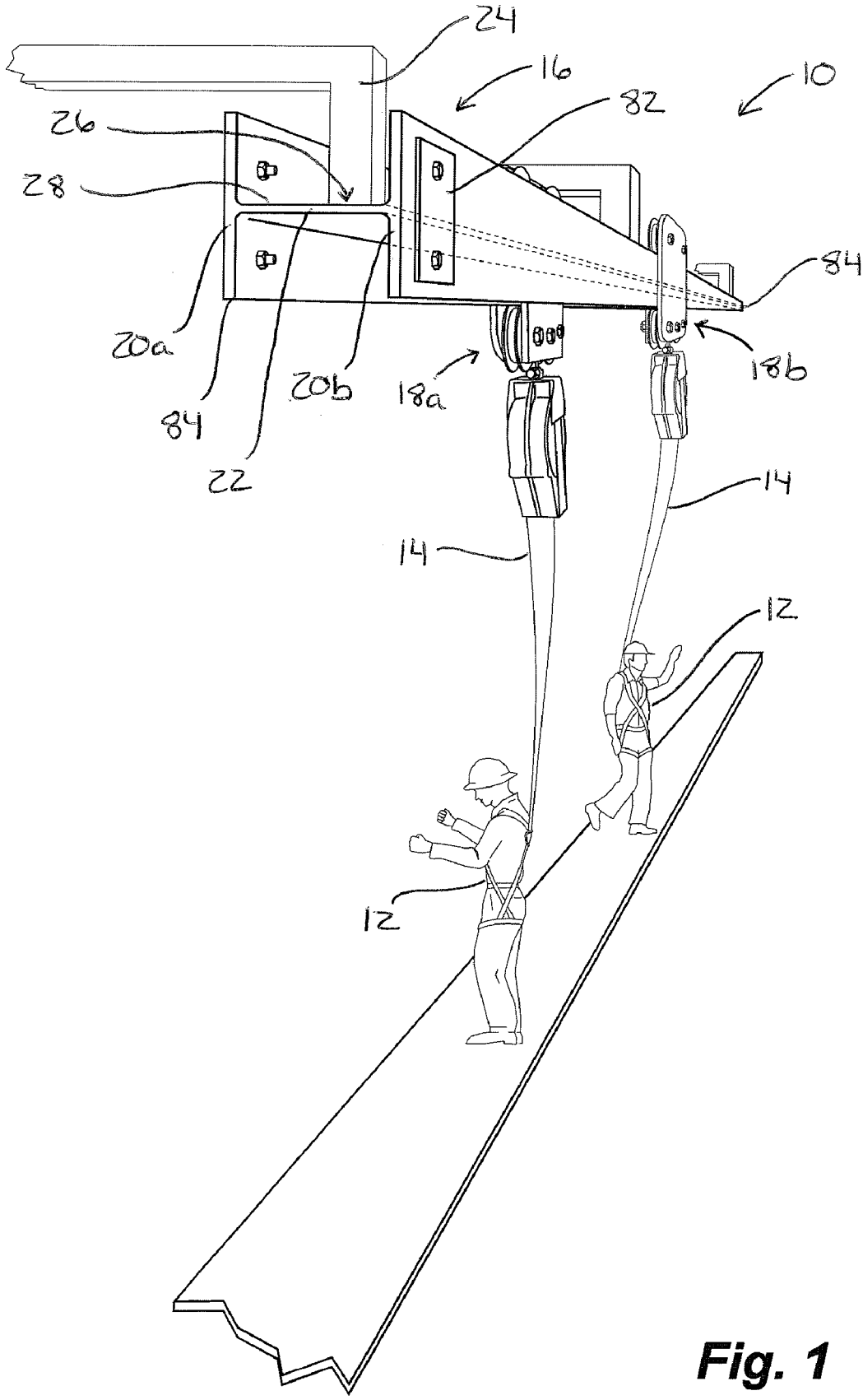
FIG. 1 is a perspective view of a fall protection apparatus in accordance with an embodiment of the invention, with the apparatus installed on an overhead structure and in use with two workers attached to the apparatus.
Figure 2:
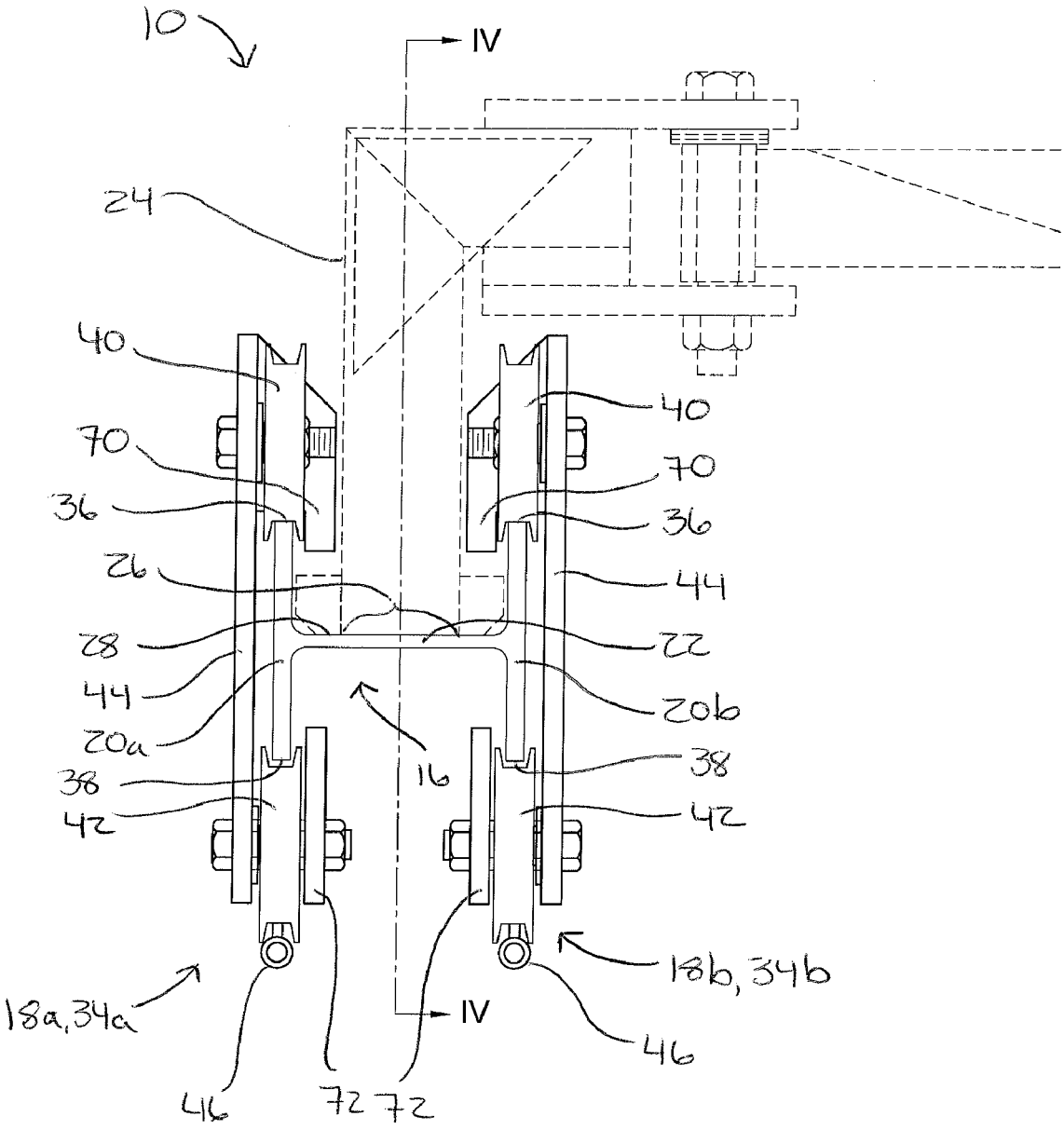
FIG. 2 is an end view of a fall protection apparatus in accordance with another embodiment of the invention.

With reference to FIG. 1, an embodiment of a fall protection apparatus 10 is shown installed on an overhead structure and in use with two workers 12, each attached to the fall protection apparatus 10 by a lanyard 14, with a self retracting lanyard being shown. With further reference to FIG. 2, the fall protection apparatus 10 generally comprises a substantially horizontally and longitudinally extending rigid rail 16 having a generally H-shaped cross-section and first and second moveable anchorages 18*a*, 18*b* attached to each of the rail 16 and a lanyard 14. More particularly, the rigid rail 16 comprises opposing substantially vertically oriented first and second longitudinally extending flanges or tracks 20*a*, 20*b* and a horizontally oriented web or connecting member 22 extending between the tracks 20*a*, 20*b* and attached thereto. The moveable anchorages 18*a*, 18*b* are mounted on the first and second tracks 20*a*, 20*b*, respectively. The first and second flanges 20*a*, 20*b* support forces from arresting falls imposed by moveable anchorages 18*a*, 18*b*. Each moveable anchorage 18*a*, 18*b* is adapted to be independently movable along the length of the respective track 20*a*, 20*b*, with the anchorages 18*a*, 18*b* being permitted to freely bypass one another.

Figure 8:
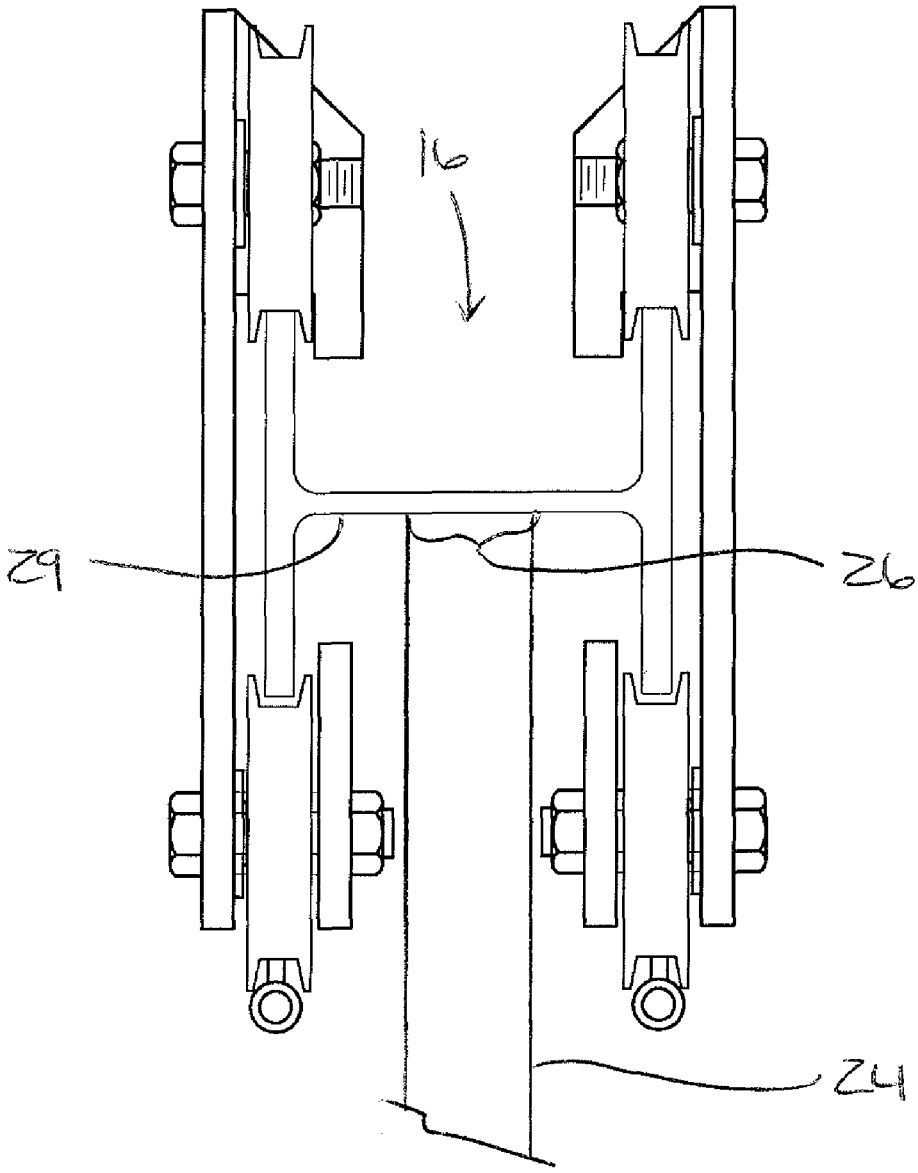
FIG. 8 is an end view of a fall protection apparatus in accordance with another embodiment of the invention, with the apparatus attached to a support member positioned below the apparatus.

The rail 16 is suspended in place by at least one overhead support member 24 secured to an attachment point 26 on an upper surface 28 of the connecting member 22. Preferably, the support members 24 are substantially vertically extending support members. In an alternative embodiment and as shown in FIG. 8, the rail 16 can be supported by a support member 24 attached to an attachment point 26 on a lower surface 29 of the connecting member 22. In any case, the tracks 20*a*, 20*b* are sufficiently spaced apart to permit attachment of the support members 24 without interfering with movement of the moveable anchorages 18*a*, 18*b*.

Overall, the fall protection apparatus 10 is constructed and used in accordance with local safety regulations, as would be appreciated by one skilled in the art.

The connecting member 22 extends substantially continuously along the length of the tracks 20*a*, 20*b*. The transverse stiffness of the rail 16 thereby exceeds the vertical stiffness such that the rail 16 does not exhibit lateral-torsional buckling in the gross cross section. The substantially continuous connecting member 22 also supports the tracks 20*a*, 20*b* to reduce or eliminate the propensity of lateral torsional buckling of the tracks 20*a*, 20*b* themselves, particularly if the connecting member is of sufficient stiffness. Consequently, the connecting member permits the tracks 20*a*, 20*b* to participate in carrying main-span loading. Consequently, the structural advantage of a substantially continuous connecting member 22 thereby permits the number of support members 24 to be reduced, thereby reducing manufacturing costs associated with the use of the fall protection apparatus 10.

The rail 16 can be of any suitable construction and fabrication which provides sufficient strength to support the forces from arresting two simultaneous falls, with the tracks 20*a*, 20*b* and the connecting member 22 being of sufficient stiffness to prevent lateral torsional buckling, as would be apparent to one skilled in the art. Preferably, the tracks 20*a*, 20*b* and the connecting member 22 are integrally formed, such as from a rolled or extruded beam, but can also be formed by welding or joining of each track to the connecting member 22. Conveniently, the rail 16 is an H-oriented flanged structural beam in which the opposing vertical flanges form the first and second tracks 20*a*, 20*b* and the web forms the connecting member 22. Despite an H-oriented flanged beam being less structurally efficient than an I-oriented flanged beam, the H-oriented flanged beam can be designed to provide the same moment of inertia or bending strength as an I-oriented flanged beam, as would be apparent to one skilled in the art. Further, while the rail 16 can be a single rail, the rail 16 can also be constructed of one or more rails attached end-to-end to form a single contiguous rail, such as by using a splice plate attached across connecting members 22 of adjacent rails (not shown).

Figure 3:
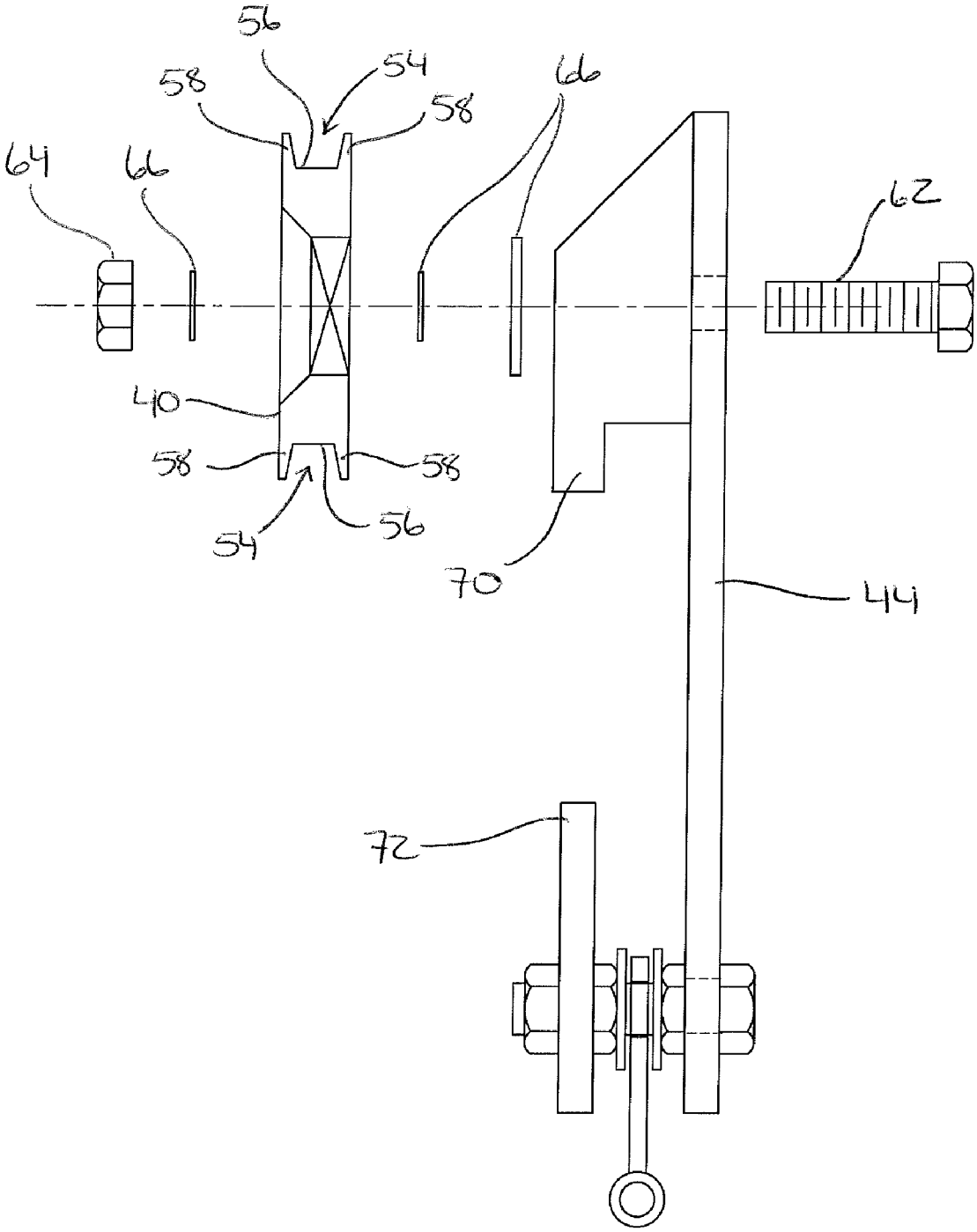
FIG. 3 is a partially exploded view of a trolley of FIG. 2, with the lower trolley wheels removed for clarity.
Figure 4:
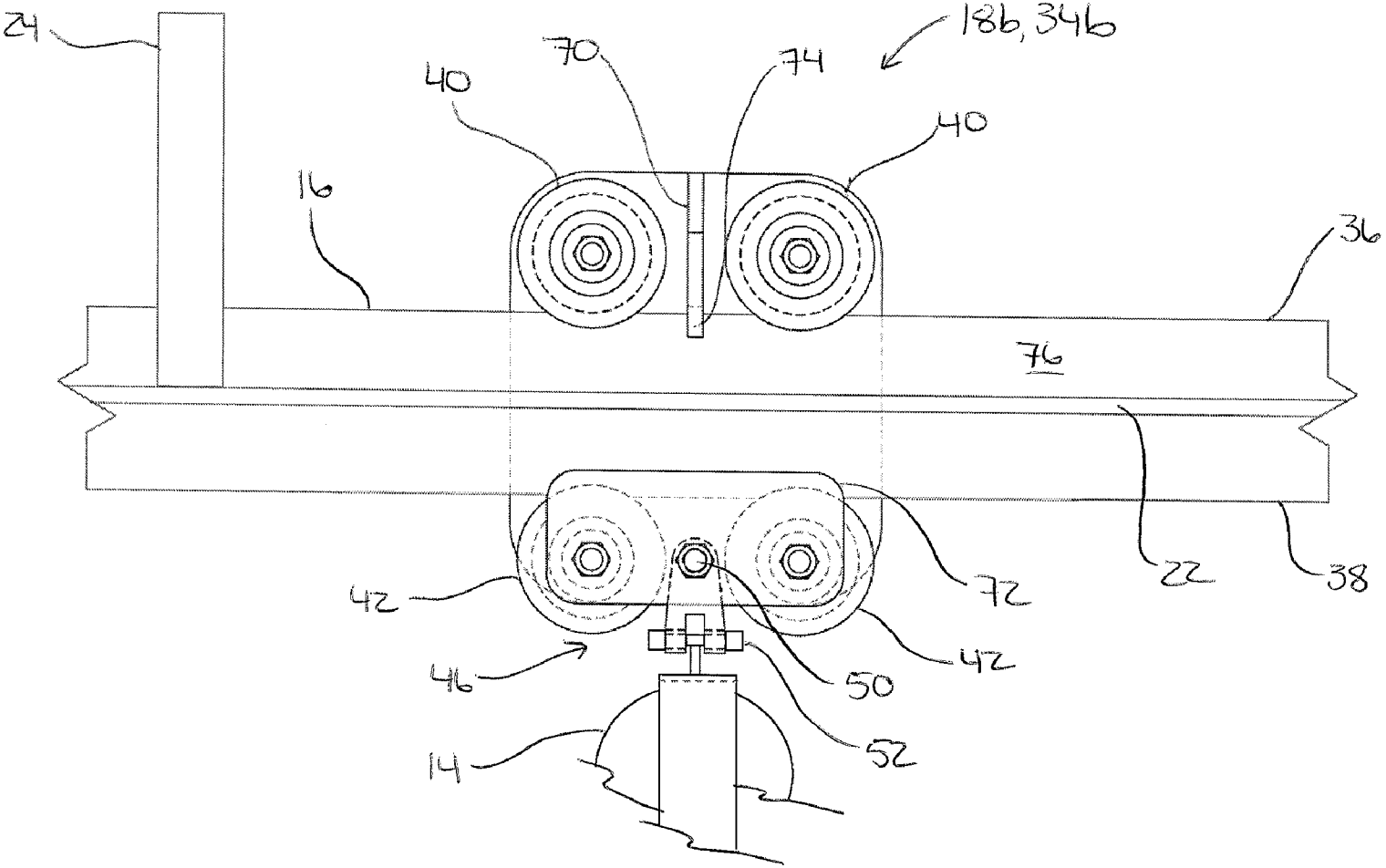
FIG. 4 is a partial sectional view of the fall protection apparatus taken along lines IV-IV of FIG. 2, and also showing a partial view of a self retracting lanyard attached to the double pivot.

With reference to FIGS. 2-4, in one embodiment, the moveable anchorages 18*a*, 18*b* are wheeled trolleys 34*a*, 34*b* and the first and second tracks 20*a*, 20*b* each form an upper edge 36 and a lower edge 38. Each trolley 34*a*, 34*b* includes at least one pair of upper and lower wheels 40, 42 positioned to engage the upper and lower edges 36, 38 respectively, of one of the tracks 20*a*, 20*b* for rolling movement therealong. While each trolley 34*a*, 34*b* is supported on the respective track 20*a*, 20*b* by engagement of at least one of the upper wheels 40 with the upper edge 36, it is generally not necessary that any lower wheels 42 be engaged with the lower edge 38 at all times.

In more detail, each trolley 34*a*, 34*b* comprises a body 44 to which the upper and lower wheels 40, 42 are rotatably mounted. Preferably, there are two pairs of longitudinally spaced apart upper and lower wheels 40, 42. A lanyard attachment point 46, extends below the body 44 to attach a worker below the fall protection apparatus 10 to one of the trolleys 34*a*, 34*b*. As best seen in FIG. 4, the lanyard attachment point 46 is preferably a double pivot assembly, which permits a self-retracting lanyard 14 to be properly oriented about each of an axial pivot 50 and lateral pivot 52 during use. Consequently, the self-retracting lanyard 14 is maintained above the head of the worker.

As best seen in FIGS. 2 and 3, the trolley wheels 40, 42 are each flanged to have an annular peripheral groove 54, the base 56 of each of which can engage the associated upper or lower edge 36, 38 of the tracks 20*a*, 20*b* while the sides 58 of which can engage the opposite surfaces of the tracks 20*a*, 20*b* for the purpose of lateral guidance.

Figure 5:
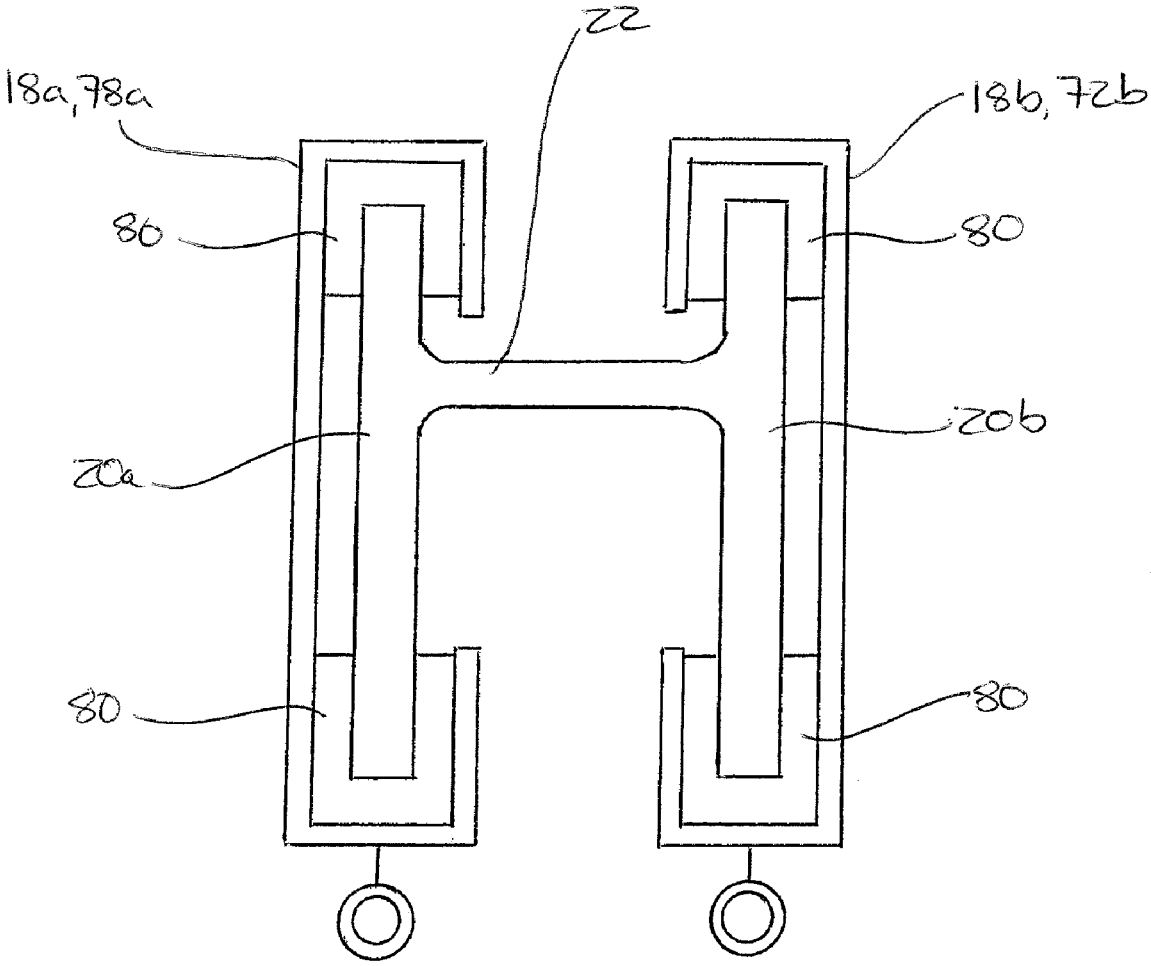
FIG. 5 is an end view of a fall protection apparatus in accordance with yet another embodiment of the invention with the apparatus having a sliding lanyard anchorage.

The wheels 40, 42 can be fabricated from any suitable material, such as suitable plastic or metal. The wheels 40, 42 are mounted on the trolley body 44 in any suitable manner. For example, as best seen in FIG. 5, the wheels 40, 42 are mounted using a bolt 62, nut 64 and washer 66 arrangement, with each wheel 40, 42 having an internal annular sealed bearing surface 68 through which the bolt 62 extends.

Preferably, each trolley 34*a*, 34*b* also includes upper and lower safety hooks 70, 72 to prevent the trolley 34*a*, 34*b* from falling off the rail 16 should one or more of the trolley wheels 40, 42 fall off or break. The upper hook 70 extends laterally inwardly and downwardly from the trolley body 44 while the lower safety hook 72 extends laterally inwardly and upwardly from the trolley body 44, with each hook 70, 72 having a portion 74 adjacent an inner side 76 of the track 20*a*, 20*b* on which the trolley 34*a*, 34*b* is respectively mounted. Preferably, the upper safety hook 70 is integrally formed with the trolley body 44 while the lower safety hook 72 may be removably attached to permit installation and removal of the trolley 34*a*, 34*b* on the rail 16 if the ends of the tracks 20*a*, 20*b* are blocked.

While the moveable anchorage 18*a*, 18*b* has thus far been described as a wheeled trolley 34*a*, 34*b*, other suitable varieties of moveable anchorages 18*a*, 18*b* are contemplated, as would be apparent to one skilled in the art. For example, with reference to FIG. 7, the moveable anchorage 18*a*, 18*b* can be a sliding anchorage 78*a*, 78*b* having a C-shaped profile that slidably engages one of the tracks 20*a*, 20*b* for longitudinal movement therealong. The sliding anchorage 78*a*, 78*b* can have low friction pads 80 or the like to aid in sliding movement. Also shown in FIG. 7, the connecting member 22 can be offset from the midpoint of the tracks 20*a*, 20*b*.

Figure 6:
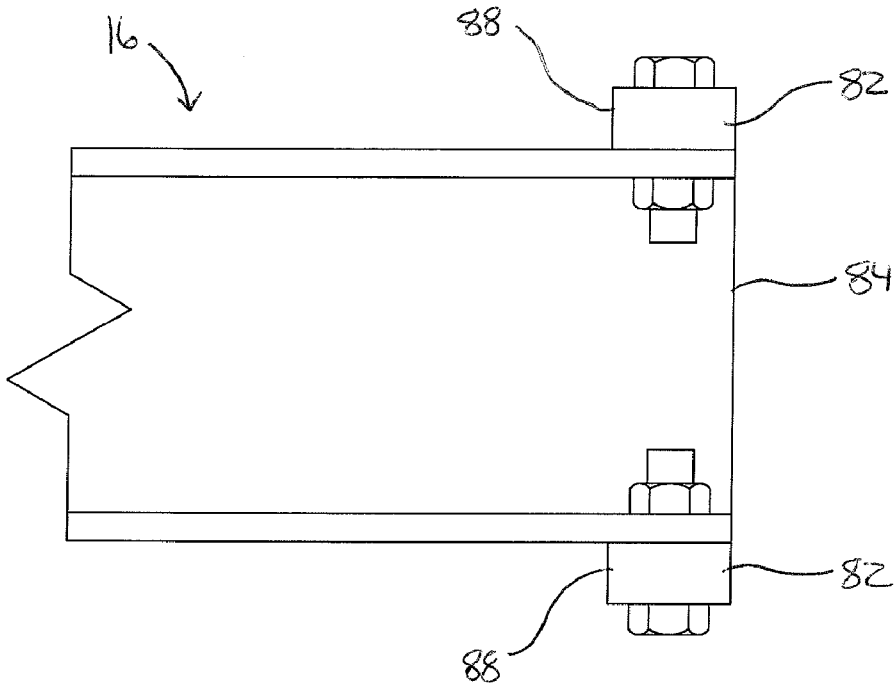
FIG. 6 is a partial top plan view of a rigid rail for a fall protection apparatus in accordance with yet another embodiment of the present invention, with the rail including an end stop.
Figure 7:
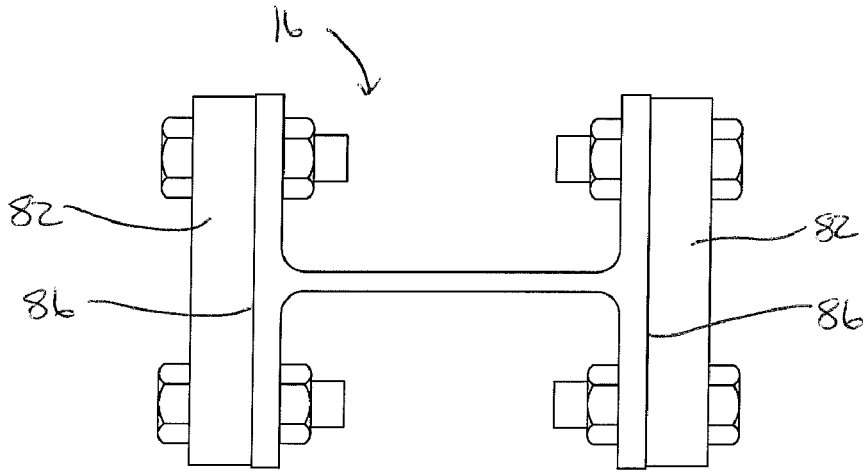
FIG. 7 is an end view of FIG. 6.

With reference to FIGS. 1, 6 and 7, fall protection apparatus 10 can also include stops 82 positioned at each end 84 of the rail 16 to prevent the moveable anchorages 18*a*, 18*b* from moving off the rail ends 84. For example, as shown, the stops 82 can be attached to the outer sides 86 of the each of the tracks 20*a*, 20*b*, with the stops 82 having a stop surface 88 against which the respective moveable anchorage 18*a*, 18*b* abuts.

Although preferred embodiments of the invention have been described in some detail herein above, those skilled in the art will recognize that various substitutions and modifications of the invention may be made without departing from the scope of the invention as defined by the claims as defined herein.

The embodiments of the invention in which an exclusive property or privilege is claimed are defined as follows:

1. A fall protection system comprising:

a longitudinally extending solid, non-tubular, rigid rail having first and second rail ends, the rail having substantially vertically oriented first and second tracks, the first and second tracks being laterally spaced apart by a substantially horizontally oriented connecting member extending between and continuously along the length of the first and second tracks between the first and second rail ends for forming a single contiguous rail having an H-shaped cross-section, the connecting member having an upper surface providing two or more attachment points spaced longitudinally along the length of the rail between the first and second rail ends and between the first and second tracks;

two or more support members spaced longitudinally along the rail and between the first and second rail ends, the two or more support members attached to the two or more attachment points for rigidly suspending the rail in place; and first and second moveable anchorages mounted on the first and second tracks for movement from the first rail end to the second rail end respectively, wherein the first and second tracks are sufficiently spaced apart to permit the first and second anchorages to pass by each other and by the two or more support members unimpeded while moving along their respective tracks between the first and second rail ends, and wherein the single contiguous rail resists lateral torsional buckling when subject to a vertical load by one or both of the first or second anchorages.

2. The system of claim 1 wherein each track has an upper edge and a lower edge; and the moveable anchorages are trolleys, each trolley comprising a body and at least one pair of upper and lower wheels rotatably mounted on the body, the upper and lower wheels positioned to engage the upper and lower edges of the first or second track for rolling movement therealong.

3. The system of claim 1 further comprising an anchorage stop secured at either end to arrest movement of the anchorages.

4. The system of claim 1 wherein the single contiguous rail is formed by two or more rails attached at the first rail end of a first rail to the second rail end of a second rail to form a single contiguous rail.

5. The system of claim 2 wherein the upper and lower wheels are flanged wheels.

6. The system of claim 2 wherein the at least one pair of upper and lower wheels comprises two pairs of upper and lower wheels.

7. The system of claim 2 wherein each trolley further comprises an upper and lower safety hook attached to the trolley body, the upper hook extending laterally inwardly and downwardly from the trolley body and the lower safety hook extending laterally inwardly and upwardly from the trolley body, with each hook having a portion adjacent an inner side of the track on which the trolley is respectively mounted for engaging the track should the at least one pair of upper and lower wheels fall off or break.

8. The system of claim 7 wherein the trolley further comprising a lanyard attachment point below the trolley body.

9. The system of claim 8 wherein the lanyard attachment point is a double pivot assembly having an axial pivot and a lateral pivot.

10. A fall protection system for permitting to workers to freely bypass one another while being protected from a fall, the system comprising:

a first wheeled trolley for attachment to a first worker;

a second wheeled trolley for attachment to a second worker;

a horizontally and longitudinally extending, H-shaped, solid non-tubular, rigid rail having first and second rail ends, the rail having opposing vertically oriented flanges, the opposing flanges being joined continuously between the first and second rail ends by a horizontally oriented web extending between the flanges for permitting the flanges to participate in carrying main-span loading for having a transverse stiffness of the rail exceeding the vertical stiffness of the rail and having a reduced propensity for torsional buckling, the rail supporting the weight of the first and second wheeled trolleys and workers attached thereto in the event of two simultaneous falls by the first and second workers, wherein the first and second flanges form first and second tracks respectively, each track having an upper edge and a lower edge, the first wheeled trolley engaging the upper and lower edges of the first track and movable thereon between the first and second rail ends and the second wheeled trolley engaging the upper and lower edges of the second track and movable thereon between the first and second rail ends; and one or more support members attached to upper or lower surfaces of the horizontally oriented web for supporting the rail, wherein the first and second flanges are spaced sufficiently apart to permit the attachment of the support members therebetween and spaced sufficiently apart to permit the first wheeled trolley to move along its first track between the first and second rail ends without interference with the support members or the second wheeled trolley and to permit the second wheeled trolley to move along its second track between the first and second rail ends without interference with the support members or the first wheeled trolley.

11. The system of claim 10 further comprising an anchorage stop secured at either of the first and second rail ends to arrest movement of the first and second wheeled trolleys.

12. The system of claim 10 wherein the rail is formed by two or more rails attached at the first rail end of a first rail to the second rail end of a second rail to form a single contiguous rail.

13. The system of claim 10 wherein each of the first and second wheeled trolleys comprises a body and at least one pair of upper and lower wheels rotatably mounted on the body, the upper and lower wheels positioned to engage the upper and lower edges of the first track, or second track, for rolling movement therealong.

14. The system of claim 13 wherein each of the upper and lower wheels are flanged wheels.

15. The system of claim 13 wherein the at least one pair of upper and lower wheels comprises two pairs of upper and lower wheels two pairs of upper and lower wheels.

16. The system of claim 13 wherein each of the first and second wheeled trolleys further comprises an upper and lower safety hook attached to the trolley body, the upper hook extending laterally inwardly and downwardly from the trolley body and the lower safety hook extending laterally inwardly and upwardly from the trolley body, with each hook having a portion adjacent an inner side of the first or second track on which the wheeled trolley is respectively mounted for engaging the track should the at least one pair of upper and lower wheels fall off or break.

17. The system of claim 16 wherein each of the first and second wheeled trolley further comprising a lanyard attachment point below the trolley body.

18. The system of claim 17 wherein the lanyard attachment point is a double pivot assembly having an axial pivot and a lateral pivot.

* * * * *